US007431283B2

(12) United States Patent
Hsieh

(10) Patent No.: US 7,431,283 B2
(45) Date of Patent: Oct. 7, 2008

(54) CARD-FEEDING MECHANISM

(75) Inventor: Tung-Ming Hsieh, Taipei Hsien (TW)

(73) Assignee: HiTi Digital, Inc., Taipei (TW)

( * ) Notice: Subject to any disclaimer, the term of this patent is extended or adjusted under 35 U.S.C. 154(b) by 345 days.

(21) Appl. No.: 11/163,430

(22) Filed: Oct. 19, 2005

(65) Prior Publication Data

US 2007/0045934 A1 Mar. 1, 2007

(30) Foreign Application Priority Data

Aug. 26, 2005 (TW) ..... 94129312 A

(51) Int. Cl.
*B65H 7/08* (2006.01)
*B65H 5/00* (2006.01)

(52) U.S. Cl. ..... 271/110; 271/114; 271/10.13

(58) Field of Classification Search ..... 271/110, 271/114, 10.01, 10.03, 10.11, 10.09, 4.03, 271/258.02
See application file for complete search history.

(56) References Cited

U.S. PATENT DOCUMENTS 5,523,858 A * 6/1996 Yamada et al. ..... 358/412
5,854,696 A * 12/1998 Yun ..... 358/498
6,019,363 A * 2/2000 Ahn ..... 271/10.05
6,485,011 B1 * 11/2002 Yen et al. ..... 271/10.03
6,837,489 B2 * 1/2005 Kim ..... 271/3.14
6,942,215 B2 * 9/2005 Kang et al. ..... 271/265.01
6,962,332 B2 * 11/2005 Su ..... 271/4.01
6,974,127 B2 * 12/2005 Kang ..... 271/10.11
2003/0002083 A1 * 1/2003 Jang et al. ..... 358/400
2003/0234965 A1 12/2003 Yang
2004/0032074 A1 * 2/2004 Park ..... 271/4.01
2005/0140080 A1 * 6/2005 So ..... 271/110

FOREIGN PATENT DOCUMENTS

CN 1145557 C 4/2004
JP 61257838 A * 11/1986

* cited by examiner

*Primary Examiner*—Patrick Mackey
*Assistant Examiner*—Luis A Gonzalez
(74) *Attorney, Agent, or Firm*—Winston Hsu

(57) ABSTRACT

A card-feeding mechanism has two rollers positioned before a limiting device, and a roller and a sensor positioned after the limiting device. When a motor rotates clockwise, a transmission device drives the three rollers simultaneously to deliver a card from a front end toward a rear end. When the sensor detects an edge of the card, the motor rotates counterclockwise, and only drives the roller after the limiting device. Then, the card is only driven by the roller after the limiting device, and the rollers before the limiting device are driven by the card.

9 Claims, 7 Drawing Sheets

CARD-FEEDING MECHANISM

BACKGROUND OF THE INVENTION

1. Field of the Invention

The present invention relates to a card-feeding mechanism, and more particularly, to a card-feeding mechanism implemented in a printer for ID cards.

2. Description of the Prior Art

A card-feeding mechanism can be positioned at an input of a printer of ID cards to deliver cards into the printer. The card-feeding mechanism drives a roller beneath a card, and when a friction force between the card and the roller is greater than a friction force between stacked cards, the card can be delivered into the printer. Furthermore, there is a limiting device in the card-feeding mechanism for assisting the bottom card in moving into the printer and keeping other cards in their respective positions.

Please refer to FIG. 1, which is a card-feeding mechanism 10 according to the prior art. A limiting device 12 of the card-feeding mechanism 10 can keep all cards 11 over a bottom card 13 in their respective positions. A roller 14 is connected to a motor 15 that drives the roller 14 to rotate and move the bottom card 13 into the printer. Additionally, there is another roller 16 positioned on the other side of the limiting device 12, and connected to a motor 17. The roller 16 is capable of assisting the card 13 in passing through the limiting device 12 until the card 13 is completely inside the printer and is ready to be printed.

The roller 14 has a rubber surface for increasing a friction coefficient between the roller and the card 13. However, often an adhesive material is added to the roller 14 for improving the friction coefficient between the roller and the card 13, and thus, the roller 14 requires constant maintenance. In addition, there is only one roller 14 before the limiting device 12 to deliver the card 13, and so the transmission of the card 13 is not very smooth. Therefore, some printers include a sensor to detect whether a card has become stuck or if there is any other malfunction during operation.

SUMMARY OF THE INVENTION

It is therefore a primary objective of the claimed invention to provide a card-feeding mechanism that has improved performance to solve the above-mentioned problem.

The claimed invention discloses a card-feeding mechanism. The card-feeding mechanism comprises a card-delivering device, a card-receiving device, a transmission device, a driver, and a sensor. The card-delivering device pushes a card in a first direction, and the card-receiving device continuously pushes the card in the first direction. The transmission device is positioned between the card-delivering device and the card-receiving device for engaging the card-delivering device and the card-receiving device when the transmission device is driven forwardly to simultaneously drive the card-delivering device and the card-receiving device, and for engaging the card-receiving device and disengaging from the card-delivering device when the transmission device is driven backwardly to drive the card-receiving device. The driver engages the transmission device for driving the transmission device. The sensor detects the pushed card. When the sensor detects the pushed card, the transmission device stops driving the card-delivering device.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
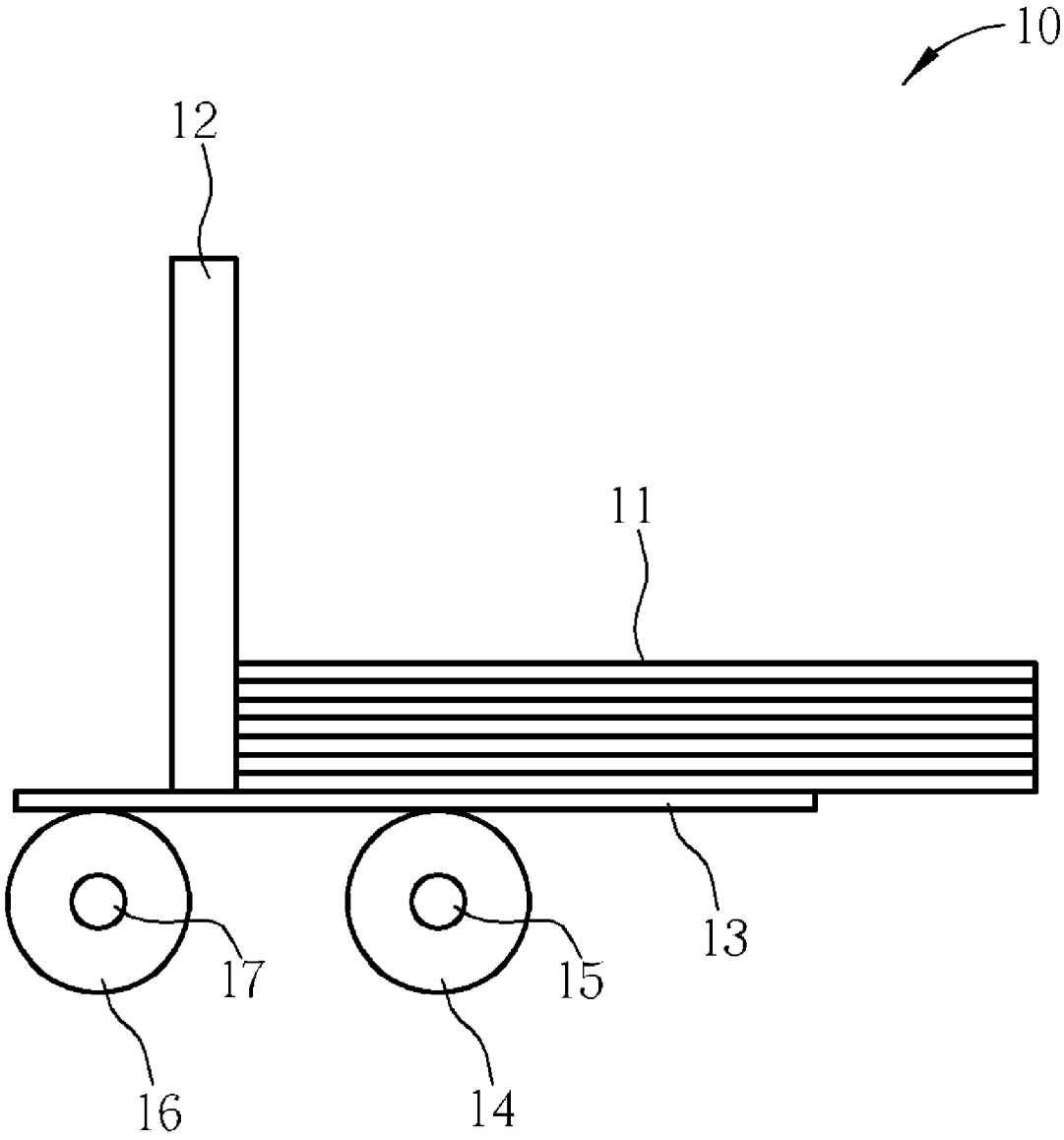
Fig. 1 Prior art
FIG. 1 is a card-feeding mechanism according to the prior art.
Figure 2:
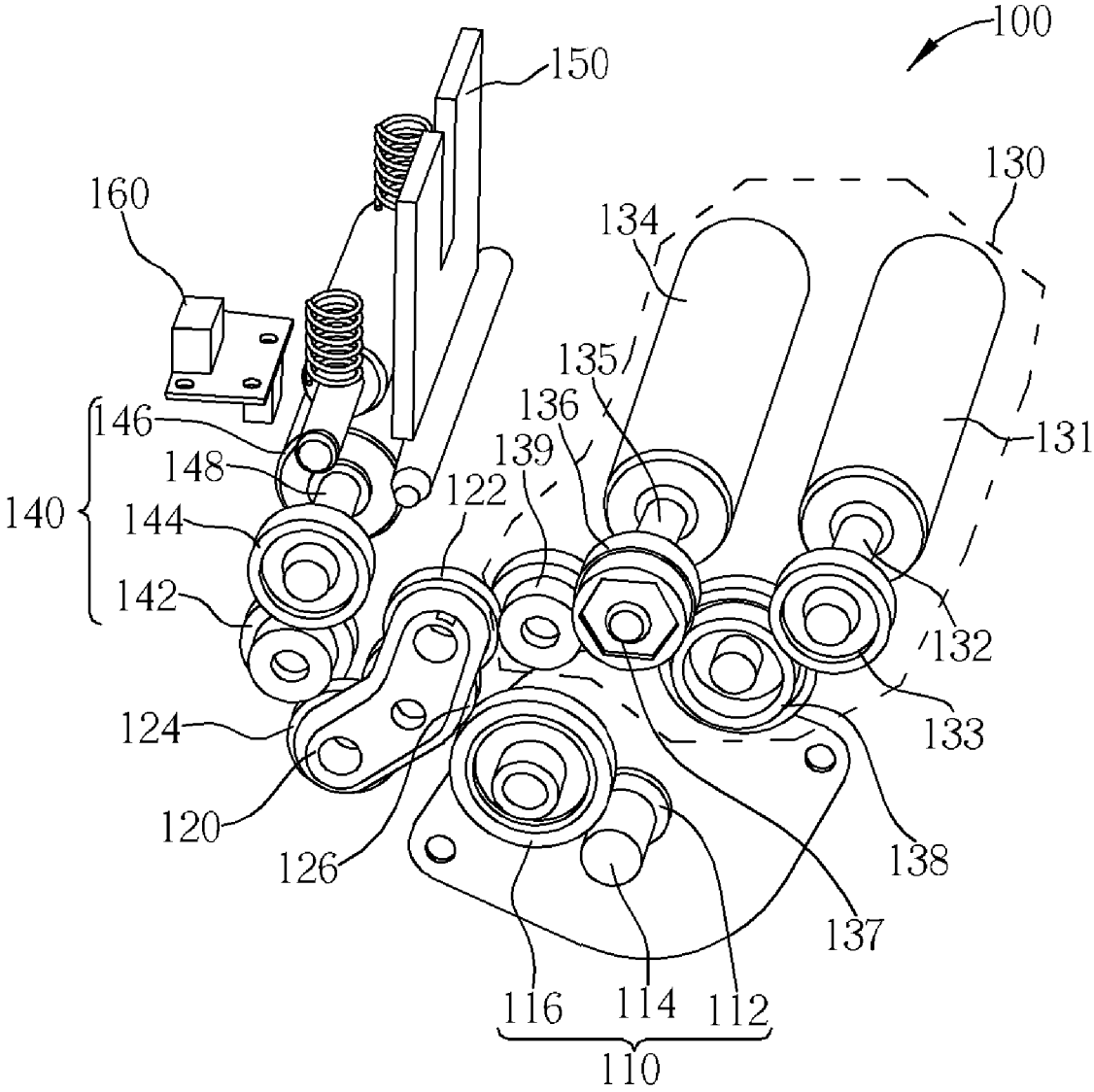
FIG. 2 shows a card-feeding mechanism based on the present invention.

Please refer to FIG. 2, which shows a card-feeding mechanism 100 based on the present invention. The card-feeding mechanism 100 comprises a card-delivering device 130, a card-receiving device 140, a transmission device 120, a driver 110, a limiting device 150, and a sensor 160. The details for each device are described as follows.

The card-receiving device 140 comprises a third roller 146 having an eighth gear 144 positioned on an axle 148 of the third roller 146, and a ninth gear 142 positioned between the eighth gear 144 and the transmission device 120. The transmission device 120 is a V-shaped panel. There are a fifth gear 122 positioned at a first end of the V-shaped panel, a sixth gear 124 positioned at a second end of the V-shaped panel, and a seventh gear 126 positioned between the fifth gear 122 and the sixth gear 124 and engaging the driver 110. The driver 110 comprises a motor 122 and a gear set comprising gears 114 and 116.

The card-delivering device 130 comprises a first roller 131 having a first gear 133 positioned on an axle 132 of the first roller 131, a second roller 134 having a second gear 136 positioned on an axle 135 of the second roller 134, a third gear 138 positioned between the first gear 133 and the second gear 136, and a fourth gear 139 positioned between the second gear 136 and the fifth gear 122 of the transmission device 120.

Figure 3:
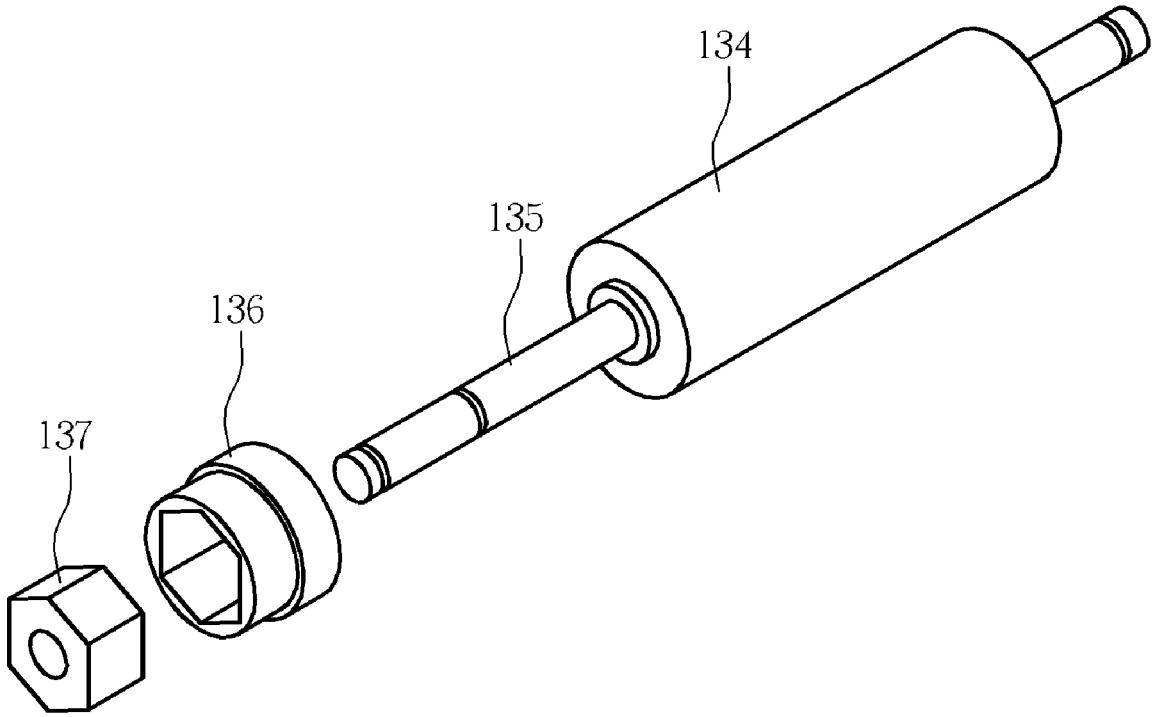
FIG. 3 shows a unidirectional bearing, the second gear, and the second roller of FIG. 2.

Please refer to FIG. 3, which shows a unidirectional bearing 137, the second gear 136, and the second roller 134 of FIG. 2. The unidirectional bearing 137 is positioned inside the second gear 136. When the transmission device 120 drives the card-delivering device 130 to rotate, the unidirectional bearing 137 causes the second gear 136 to drive the second roller 134 to rotate. The unidirectional bearing 137 causes the second roller 134 not to drive the second gear 136 to rotate when the transmission device 120 does not drive the card-delivering device 130.

Figure 4:
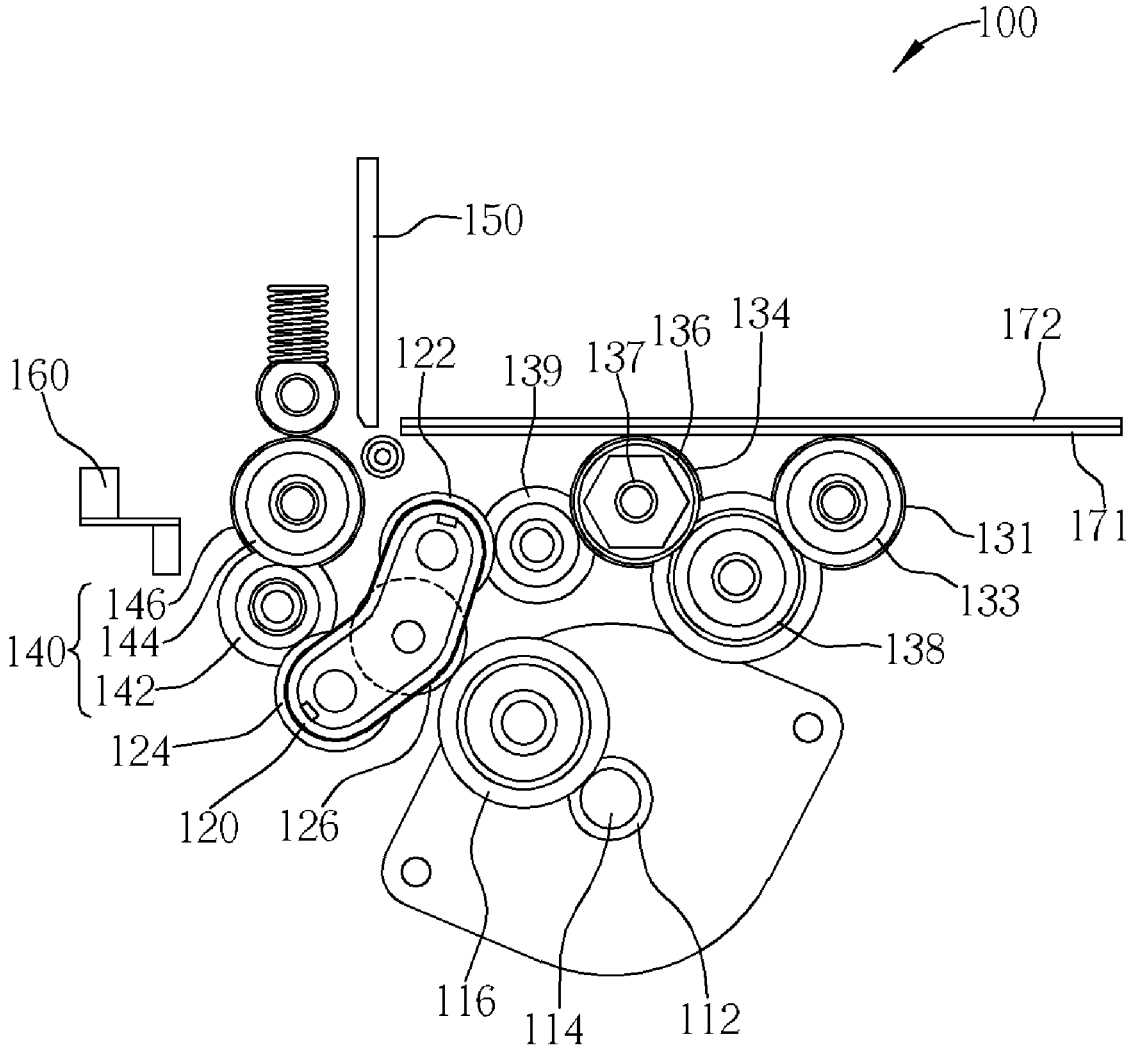
FIG. 4 is a lateral view when the card-feeding mechanism of FIG. 2 is not operating.

Please refer to FIG. 4, which is a lateral view when the card-feeding mechanism 100 of FIG. 2 is not operating. The limiting device 150 limits a thickness of cards 171, 172 to ensure there is only one card passing through the limiting device 150 at a time. When the card-feeding mechanism 100 does not operate, the fifth gear 122 of the transmission device 120 engages the fourth gear 139 of the card-delivering device 130 while the sixth gear 124 of the transmission device 120 engages the ninth gear 142 of the card-receiving device 140. The seventh gear 126 of the transmission device 120 engages the gear 116 of the driver 110 for receiving a rotating force provided by the motor 112.

Figure 5:
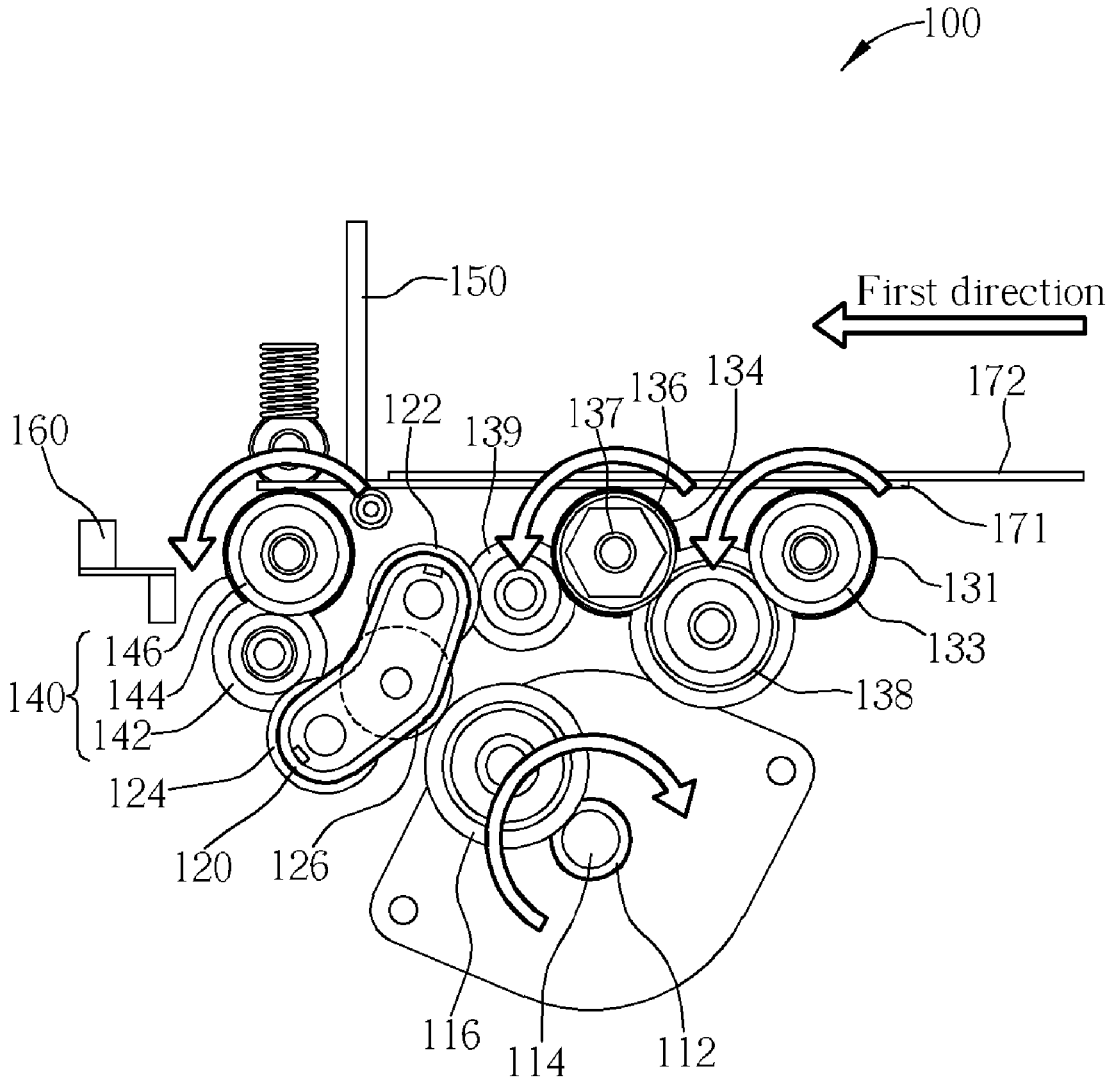
FIG. 5 to FIG. 7 show how the card-feeding mechanism of the present invention operates.

Please refer to FIG. 5, which is a lateral view when the card-feeding mechanism 100 of FIG. 2 starts to operate.

When the motor 112 starts to rotate clockwise, the gear 114 positioned on the motor 112 also rotates clockwise, and provides the rotating force to the transmission device 120 via the gear 116. After the motor 112 rotates, the V-shaped panel swings to engage the fifth gear 122 with the eighth gear 144, and then swings to engage the fourth gear 139 with the ninth gear 142. Therefore, the transmission device 120 is simultaneously connected to the card-delivering device 130 and the card-receiving device 140 via the fifth gear 122 and the sixth gear 124 to cause the transmission device 120 to drive the card-delivering device 130 and the card-receiving device 140. As shown in FIG. 5, the first gear 133, the second gear 136, and the eighth gear 144 rotate counterclockwise simultaneously and drives rollers 131, 134, 146 correspondingly.

The friction forces between the card 171 and the first roller 131, and between the card 171 and the second roller 134 are greater than the friction force between the cards 171 and 172 due to the rotation of the first roller 131 and the second roller 134. Therefore, the card 171 can be pushed in a first direction. When the card 171 passes through the limiting device 150, the third roller 146 of the card-receiving device 140 assists the card 171 in moving in the first direction.

Figure 6:
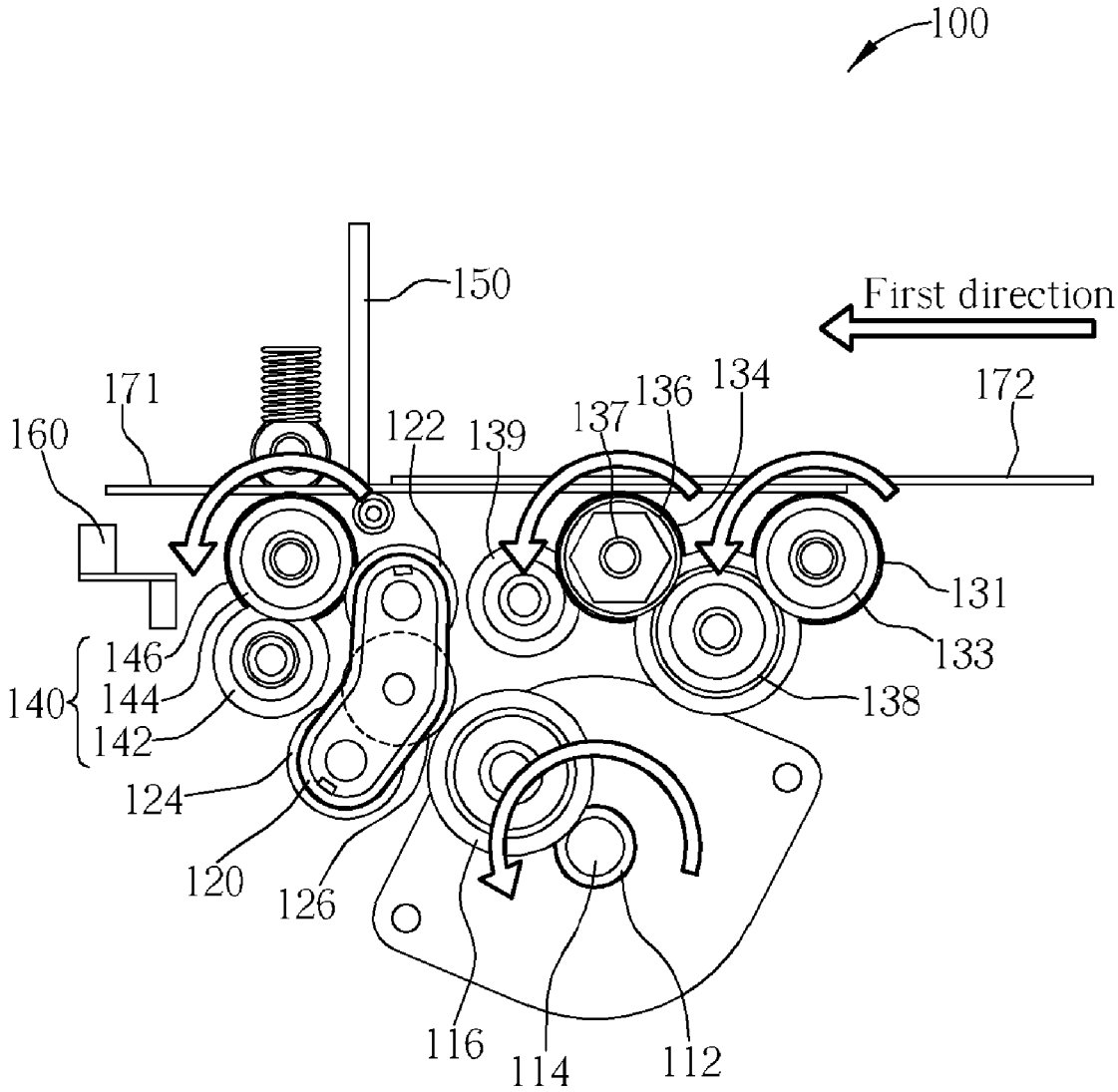

Please refer to FIG. 6, which is a lateral view when the motor 112 rotates in reverse. When the sensor 160 detects the card 171, a signal is sent to cause the motor 122 to rotate in reverse (counterclockwise). At the same time, the seventh gear 126 receives a reverse rotation. Since a torque generated by the friction force between the V-shaped panel and the central axle of such is smaller than a torque generated by the friction force between the V-shaped panel and the fifth gear 122, and between the V-shaped panel and the sixth gear 124, when the motor 122 rotates in reverse, the fifth gear 122 of the transmission device 120 disengages the fourth gear 139 of the card-delivering device 130, and engages the eighth gear 144 of the card-receiving device 140. The sixth gear 124 of transmission device 120 also disengages the ninth gear 142 of the card-receiving device 140. Therefore, in FIG. 6, the transmission device 120 only drives the card-receiving device 140 while the first roller 131 and the second roller 134 are driven by the movement of the card 171.

Figure 7:
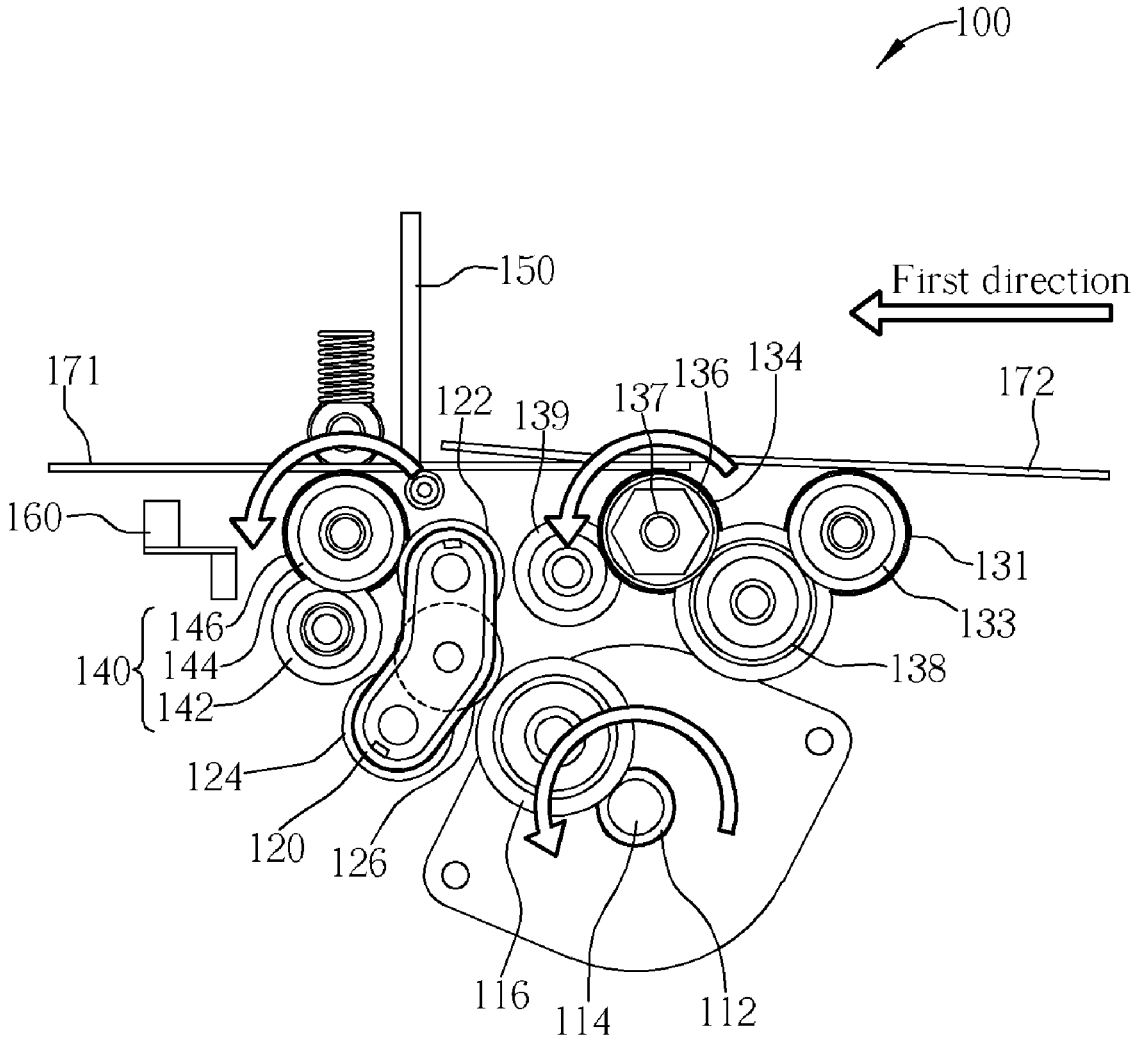

Please refer to FIG. 7, which is a lateral view after the motor 122 rotates in reverse. In FIG. 7, the card 171 departs from the first roller 131, and only drives the second roller 134 to rotate. Due to the unidirectional bearing 137, the rotation of the second roller 134 will not drive the second gear 136 to rotate. Thus, the second gear 136 and the unidirectional bearing 137 of FIG. 7 remain still. The card 172 on top of the card 171 contacts the first roller 131. Because of the friction force between the card 172 and the first roller 131, the first roller 131 is still until the card 171 is completely pushed into the printer to cause the motor 122 to rotate clockwise, thereby starting to push the next card 172 into the printer.

Compared to the prior art, the card-feeding mechanism 100 of the present invention utilizes the first roller 131 and the second roller 134 to simultaneously push the card 171 in the first direction. This means that the card 171 is transferred more smoothly. Additionally, the friction force between the card and the two rollers 131, 134 is increased, and thereby the present invention does not require adhesive material on the rollers 131, 134, increasing a life-span of the rollers 131, 134.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A card-feeding mechanism comprising:

a card-delivering device for pushing a card of a card stack in a first direction;

a card-receiving device for continuously pushing the card in the first direction;

a transmission device positioned between the card-delivering device and the card-receiving device for engaging the card-delivering device and the card-receiving device when the transmission device is driven forwardly to simultaneously drive the card-delivering device and the card-receiving device, and for engaging the card-receiving device and disengaging from the card-delivering device when the transmission device is driven backwardly to drive the card-receiving device;

a driver engaging the transmission device for driving the transmission device; and a sensor for detecting the pushed card, wherein when the sensor detects the pushed card, the transmission device stops driving the card-delivering device;

wherein the card-delivering device comprises:

a first roller positioned below the card stack for pushing the card in the first direction;

a first gear positioned on an axle of the first roller;

a second roller positioned below the card stack for pushing the card in the first direction;

a second gear positioned on an axle of the second roller;

a third gear positioned between the first gear and the second gear;

a fourth gear positioned between the second gear and the transmission device for receiving a rotating force of the transmission device when engaging the transmission device; and a unidirectional bearing positioned inside the second gear for causing the second gear to drive the second roller to rotate when the transmission device drives the card-delivering device, and for causing the second roller not to drive the second gear to rotate when the transmission device does not drive the card-delivering device.

2. The card-feeding mechanism of claim 1, wherein the transmission device is a V-shaped panel, the V-shaped panel comprising:

a fifth gear positioned at a first end of the V-shaped panel for driving the card-delivering device when engaging the card-delivering device, and for driving the card-receiving device when engaging the card-receiving device;

a sixth gear positioned at a second end of the V-shaped panel for driving the card-receiving device when engaging the card-receiving device; and a seventh gear positioned between the fifth gear and the sixth gear and engaging the driver for receiving the rotating force provided by the driver.

3. The card-feeding mechanism of claim 1, wherein the card-receiving device comprises:

an third roller for continuously pushing the card in the first direction;

an eighth gear positioned on an axle of the third roller for receiving the rotating force of the transmission device when engaging the transmission device to drive the third roller to rotate; and a ninth gear positioned between the eighth gear and the transmission device for receiving the rotating force of the transmission device to drive the eighth gear.

4. The card-feeding mechanism of claim 1 further comprising a limiting device positioned between the card-delivering device and the card-receiving device for limiting a thickness of the pushed card.

5. The card-feeding mechanism of claim 1, wherein the driver comprises a motor and a gear set for providing the rotating force.

6. A card-feeding mechanism comprising:

a card-delivering device for pushing a card of a card stack in a first direction;

a card-receiving device for continuously pushing the card in the first direction;

a V-shaped panel positioned between the card-delivering device and the card-receiving device for engaging the card-delivering device and the card-receiving device when the V-shaped panel is driven forwardly to simultaneously drive the card-delivering device and the card-receiving device, and for engaging the card-receiving device and disengaging from the card-delivering device when the V-shaped panel is driven backwardly to drive the card-receiving device;

a driver engaging the V-shaped panel for driving the V-shaped panel; and a sensor for detecting the pushed card, wherein when the sensor detects the pushed card, the V-shaped panel stops driving the card-delivering device;

wherein the card-delivering device comprises:

a first roller positioned below the card stack for pushing the card in the first direction;

a first gear positioned on an axle of the first roller;

a second roller positioned below the card stack for pushing the card in the first direction;

a second gear positioned on an axle of the second roller;

a third gear positioned between the first gear and the second gear; and a fourth gear positioned between the second gear and the V-shaped panel for receiving a rotating force of the V-shaped panel when engaging the V-shaped panel; and wherein the V-shaped panel comprising:

a fifth gear positioned at a first end of the V-shaped panel for driving the card-delivering device when engaging the card-delivering device, and for driving the card-receiving device when engaging the card-receiving device;

a sixth gear positioned at a second end of the V-shaped panel for driving the card-receiving device when engaging the card-receiving device; and a seventh gear positioned between the fifth gear and the sixth gear and engaging the driver for receiving the rotating force provided by the driver.

7. The card-feeding mechanism of claim 6, wherein the card-receiving device comprises:

an third roller for continuously pushing the card in the first direction;

an eighth gear positioned on an axle of the third roller for receiving the rotating force of the V-shaped panel when engaging the V-shaped panel to drive the third roller to rotate; and a ninth gear positioned between the eighth gear and the V-shaped panel for receiving the rotating force of the V-shaped panel to drive the eighth gear.

8. The card-feeding mechanism of claim 6 further comprising a limiting device positioned between the card-delivering device and the card-receiving device for limiting a thickness of the pushed card.

9. The card-feeding mechanism of claim 6, wherein the driver comprises a motor and a gear set for providing the rotating force.

* * * * *